United States Patent [19]

Reinehr et al.

[11] Patent Number: 4,810,448

[45] Date of Patent: Mar. 7, 1989

[54] PROCESSES FOR THE PRODUCTION OF DRY-SPUN POLYACRYLONITRILE PROFILED FIBRES AND FILAMENTS

[75] Inventors: Ulrich Reinehr; Kurt Bernklau; Toni Herbertz, all of Dormagen; Hermann-Josef Jungverdorben, Grevenbroich; Hans K. Burghartz, Neuss, all of Fed. Rep. of Germany

[73] Assignee: Bayer Aktiengesellschaft, Leverkusen, Fed. Rep. of Germany

[21] Appl. No.: 41,890

[22] Filed: Apr. 22, 1987

Related U.S. Application Data

[60] Continuation of Ser. No. 449,926, Dec. 15, 1982, abandoned, which is a division of Ser. No. 311,807, Oct. 15, 1981, abandoned.

[30] Foreign Application Priority Data

Oct. 30, 1980 [DE] Fed. Rep. of Germany ..... 3040970

[51] Int. Cl.[4] ..... D01F 6/18; D01D 5/04

[52] U.S. Cl. ..... 264/177.13; 264/177.2; 264/206; 264/211.14; 264/211.17

[58] Field of Search ..... 264/204, 205, 206, 207, 264/182, 177.13, 177.2, 211.14, 211.17

[56] References Cited

U.S. PATENT DOCUMENTS

| | | | |
|---|---|---|---|
| 2,843,449 | 7/1958 | Raynolds | 264/177 F |
| 3,131,428 | 5/1964 | Mika | 264/172 F |
| 3,194,002 | 7/1965 | Raynolds et al. | 428/397 |
| 3,340,571 | 9/1967 | Bishop et al. | 425/464 |
| 3,579,625 | 5/1971 | Jacquinet | 264/207 |
| 4,336,214 | 6/1982 | Reinehr | 264/206 |

FOREIGN PATENT DOCUMENTS

| | | | |
|---|---|---|---|
| 729518 | 3/1966 | Canada . | |
| 750852 | 1/1967 | Canada | 428/397 |
| 2804376 | 6/1979 | Fed. Rep. of Germany | 264/177 F |
| 46-6541 | 2/1971 | Japan | 264/177 F |
| 47-8189 | 3/1972 | Japan | 264/177 F |
| 54-6919 | 1/1979 | Japan | 264/177 F |

OTHER PUBLICATIONS

"Synthesefasein", Belavon Falkai, Verlog Chemie, Weinhum 1981 pp. 198 & 208.

"Polymer Process", Schildknecht, Interscience Publishers, 1956, pp. 843-844.

*Primary Examiner*—Jan H. Silbaugh

*Assistant Examiner*—Hubert C. Lorin

*Attorney, Agent, or Firm*—Sprung Horn Kramer & Woods

[57] ABSTRACT

A process for the production of acrylonitrile fibers and filaments having a precise cross-sectional profile in which filament-forming synthetic polymers are dry-spun from a solution having a viscosity of at least 120 falling bass seconds, measured at 80° C., or a viscosity of at least 75 falling ball seconds, measured at 100° C. Such solution is dry-spun through one or more nozzles. The nozzle hole are of the profile nozzles being less than 0.2 $mm^2$ and the lateral width being less than 0.17 mm.

11 Claims, 2 Drawing Sheets

PROCESSES FOR THE PRODUCTION OF DRY-SPUN POLYACRYLONITRILE PROFILED FIBRES AND FILAMENTS

This is a continuation of application Ser. No. 449,926, filed Dec. 15, 1982, now abandoned, which in turn is a division of application Ser. No. 311,807, filed Oct. 15, 1981, now abandoned.

BACKGROUND OF THE INVENTION

The production of synthetic fibres having a modified fibre cross section according to melt- and wet-spinning technology has been known for many years. Thus, for example, polyamide and polyester fibres are preferably produced from profiled spinnerets by melt-spinning in order to achieve special effects with respect to gloss, hand, lustre and final quality of the fabric. The effects which the change in the filament cross-sectional form of synthetic fibres has in particular on the final quality and on the behaviour of finished goods emerges, for example, from the reports by F. Bolland in Chemiefasern 13 (1963), pages 42–45 and 106–109, and from the article by H. Bieser and R. Hesse in Chemiefasern 17 (1967), pages 262–268. H. Knopp reports in Lenzinger Berichten 36 (1974), pages 160–167, on improved utility characteristics and stylish effects in the production of nylon-6 profiled yarns with a triangular profile. A Lehnen and G. Satlow report in Chemiefasern und Textilindustrie, March 1975, pages 251–254, on the improved soiling behaviour of textile flooring materials made of polyamide-6,6 yarns having a deeply-lobed trilobal cross-section. In addition to melt-spinning technology, synthetic fibres which are modified in cross section, for example cross-section-modified acrylic fibres, may also be produced by wet-spinning. Thus, acrylic fibres having a triangular fibre cross section are available on the market, and are distinguished by a high colour brilliance.

Many attempts have also been made hitherto to produce profiled acrylic fibres from a spinning solution by dry-spinning. Thus, for example, the profile spinning of polyacrylonitrile by dry-spinning is supposed to be known according to U.S. Pat. No. 3,760,053, but no experimental evidence is disclosed. Furthermore, U.S. Pat. No. 3,340,571 also names acrylonitrile homo- and copolymers among the dry-spinnable polymers which produce profiled fibres using profiled nozzles, but experiments are actually submitted only for cellulose acetate. In any case, no commercial process has been disclosed hitherto for the production of cross-section-modified acrylic fibres by dry-spinning. For example, when dry-spinning polyacrylonitrile spinning solutions in a conventional concentration and using profiled nozzles, a dumbbell-shaped cross section is only ever obtained, i.e. for example, using an acrylonitrile copolymer, consisting of 93.6% by weight of acrylonitrile, 5.7% by weight of methyl acrylate and 0.7% by weight of sodium methallyl sulphonate and having a K value of 81, and a 32% by weight spinning solution in dimethylformamide. If it is attempted further to increase the solids content, then spinning solutions of this type gelatinize upon cooling even at temperatures of from about 50° to 80° C., so that trouble-free spinning is impossible.

SUMMARY OF THE INVENTION

An object of the present invention is to provide a dry spinning process of this type, because of the various possibilities of use of such fibres and filaments.

Surprisingly, it has now been found that it is possible to produce any random pre-determined cross-sectional profile by dry-spinning, when spinning solutions having a viscosity exceeding a specific value are used and when profiled nozzles having specific dimensions are used. The expression "fibres having a precise cross-sectional profile" is understood to mean those fibres, from whose cross section the geometry of the profiled nozzle used may be recognised, and the expression "a profiled nozzle" is understood to mean any nozzle bore, excluding the simple round nozzle bore. Simple geometric shapes in particular are used.

Thus, the invention provides dry-spun polyacrylonitrile fibres which have a precise cross-sectional profile. Acrylonitrile polymers which are suitable for the production of filaments and fibres are acrylonitrile homo- and copolymers, the copolymers containing at least 50% by weight, preferably at least 85% by weight, of acrylonitrile units polymerised therein.

The invention also provides a process for the production of acrylic fibres and filaments which have a precise cross-sectional profile, characterised in that the filament-forming synthetic polymers are dry-spun from a solution which has a viscosity of at least 120 falling ball seconds, measured at 80° C., or a viscosity of at least 75 falling ball seconds, measured at 100° C., and the nozzle hole area of the profiled nozzle is smaller than 0.2 $mm^2$ and the lateral width is smaller than 0.17 mm.

The spinning operation is accompanied by the conventional further procedural steps of acrylonitrile dry spinning processes.

Figure 1:
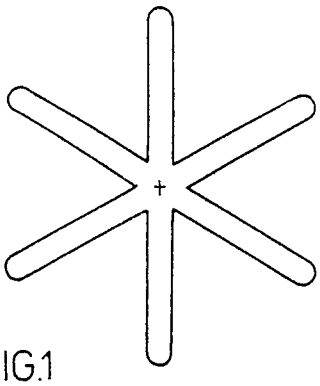
FIG. 1 is a plan view of a hexalobal shaped nozzle hole configuration for use in the present invention.
Figure 2:
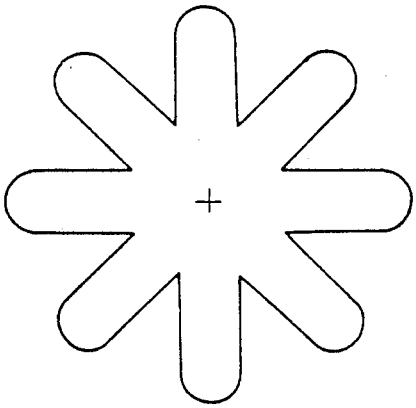
FIG. 2 is a plan view of an octalobal shaped nozzle hole configuration for use in the present invention.
Figure 3:
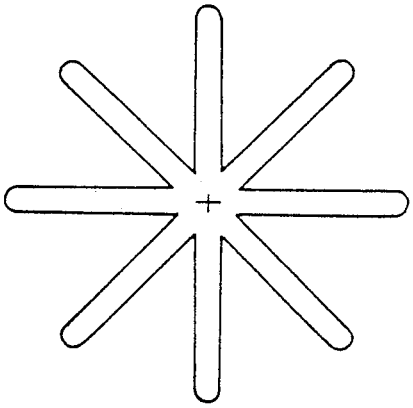
FIG. 3 is a plan view of another octalobal shaped nozzle hole configuration for the use in the present invention.
Figure 4:
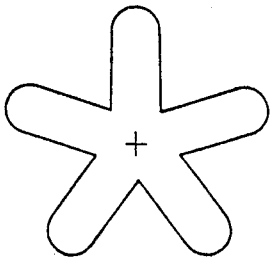
FIG. 4 is a plan view of a pentalobal shaped nozzle hole configuration for use in the present invention.
Figure 5:
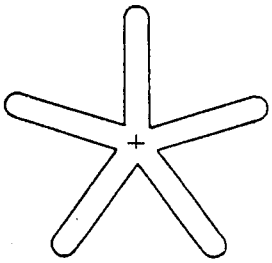
FIG. 5 is a plan view of another pentalobal shaped nozzle hole configuration for use in the present invention.
Figure 6:
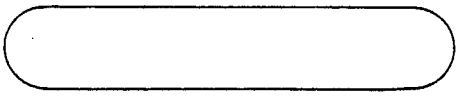
FIG. 6 is a plan view of a monolobal (rectangular) shaped nozzle hole configuration for use in the present invention.
Figure 7:
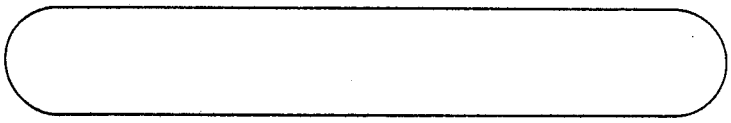
FIG. 7 is a plan view of another monolobal (rectangular) shaped nozzle hole configuration for use in the present invention.

The viscosity in falling ball seconds, measured at 80° or 100° C., is determined according to the method of K. Jost, Reologica Acta, Vol. 1 (1958), page 303. The term "lateral width of a profiled nozzle" is understood to mean the distance between the opposite boundaries of the predetermined profile shape in mm, and not the distance to the centre of the nozzle hole. In the case of nozzle hole shapes whose lateral width may not be easily defined, e.g. a profiled nozzle having triangular holes, the distance between two opposite lateral centres as the average lateral width is determined as the lateral width. It has been shown that precise cross-sectional profiles may always be spun according to the invention when the nozzle hole area is smaller than 0.2 $mm^2$ and the lateral width is smaller than 0.17 mm. It is particularly preferred to use lateral widths of from 0.02 to 0.06 mm and nozzle hole areas of up to 0.1 $mm^2$. Where the nozzle hole areas are larger than 0.2 $mm^2$, a blending of the cross sectional shapes takes place. Blurred, bizarre structures are obtained, ranging from lumpy to shapelessly deformed.

The following shapes have proved to be suitable profiles in the production of cross-section-modified fibres according to the process of the invention: triangular, Y-shaped, cross-shaped, pentalobal, hexalobal, octalobal and rectangular shapes. Other cross-section modifications as described, for example, in Chim. Volokna 5 (1972), pages 58–61, by V. F. Krasnikov or by M. Schwab in Chemiefasern und Textilindustrie September 1977, page 770, may similarly also be made into products according to the invention by the process of the invention.

Spinning solutions of the viscosity specified which also contain a higher concentration of the filament-forming polymer are obtained according to German Offenlegungsschrift No. 2,706,032 by producing correspondingly concentrated suspensions of the filament-forming polymer, which are easily transportable, in the required solvent and by converting this suspension into viscosity-stable spinning solutions by heating for a short time to temperatures which are just below the boiling point of the spinning solvent used. The suspensions for the production of such spinning solutions are obtained by mixing the spinning solvent, if required, with a non-solvent for the polymer to be spun and then by adding the polymer with stirring. All substances are included as non-solvents within the meaning of the invention which are a non-solvent for the polymer and which may be mixed with the spinning solvent in wide limits. The boiling points of the non-solvents may be either below or above the boiling point of the spinning solvent used. Such substances, which may be present in a solid or liquid aggregate condition, are the following, for example: alcohols, esters or ketones and mono- or multi-substituted alkyl ethers and esters of multihydric alcohols, organic or inorganic acids, salts and the like. Water is used as a first preferred non-solvent, owing to its simple handling and removal in the spinning duct without a residue formation and recovery, and glycerine, mono- and tetraethylene-glycol and sugar are used as second preferred non-solvents.

When using non-solvents whose boiling point is below that of the spinning solvent, the known type of acrylic fibres are obtained, having a water retention capacity of less than 10%, for example from 4.5 to 6%. When using non-solvents whose boiling point is above that of the spinning solvent, acrylic fibres are obtained, as already described in German Offenlegungsschrift No.2,554,124, which have a water retention capacity of more than 10% and are distinguished by particular wear properties. In the first case, the non-solvent is removed in the spinning duct, while in the second case the non-solvent has to be washed out of the consolidated fibre in a further process step, subsequent to the spinning process. When using water as the non-solvent and when using the acrylonitrile copolymer with a K value of 81, mentioned above, spinning solutions of the required viscosity having a solids concentration of 36% by weight or more can be obtained. The filaments dry-spun therefrom exhibit fibre cross sections which are precise within the meaning of the invention.

The proportion of water is such suspensions of polyacrylonitrile and dimethylformamide is in the range of from 2 to 10% by weight, based on the total suspension. Where the water content is less than 2% by weight, a flowable and transportable suspension is no longer obtained, but instead a thick and sluggish paste is produced. On the other hand, if the water content is more than 10% by weight, the filaments burst during the spinning process below the nozzle, due to the steam partial pressure which is too high when issuing from the nozzle holes. The percentage of water in the spinning solution only slightly influences the profiling action at the nozzle, as is apparent from Table II for a 35% spinning solution or for a 36% spinning solution. It is crucial for the spinning solution to have the minimum viscosity specified. In the case of solids contents of up to 40%, water portions of from 2 to 3% by weight have proved to be optimum in order to obtain suspensions which are still flowable and transportable at room temperature. If, instead of water, another non-solvent is used, for example propanol or butanol, then the same results are achieved. When using acrylonitrile polymers having a K value of 81, then, as already shown above, spinning solutions are obtained having the required minimum viscosity and a concentration of 36% by weight or more of filament-forming polymer. In the case of acrylonitrile copolymers having lower K values, the minimum viscosities required for the spinning solution may only be achieved at higher concentrations. Thus, for example, from an acrylonitrile copolymer consisting of 92% of acrylonitrile, 6% of methyl acrylate and 2% of sodium methallyl sulphonate and having a K value of 60, a suspension may be produced consisting of 45% of copolymer solids, 4% of water and 51% of dimethylformamide, which is still flowable at room temperature and which on heating produces a spinning solution which has a viscosity of 142 falling ball seconds at 80° C. Spinning this spinning solution from profiled nozzles produces fibres which have a precise cross-sectional profile within the meaning of this invention. On the other hand, when using polymers which have a higher K value, the required viscosity of the spinning solution may also be achieved when using a lower solids concentration. Thus, for example, even a 27.5% spinning solution of an acrylonitrile homopolymer having a K value of 91, dissolved in DMF, produces a viscosity of 138 falling ball seconds. Precise cross-sectional profiles are obtained by dry-spinning from profiled nozzles.

When using monoethylene glycol as the non-solvent and when using the acrylonitrile copolymer of K value 81 mentioned above, spinning solutions can be produced having a solids concentration of 36% by weight or more, whose viscosities amount to at least 75 falling ball seconds, measured at 100° C. Fibres having a precise cross-sectional profile were spun from these spinning solutions and they were distinguished by a high water retention capacity after the non-solvent was washed out and after the conventional after treatment. The non-solvent portion of such suspensions consisting of polyacrylonitrile, dimethylformamaide and monoethylene glycol must amount to at least 5% by weight, based on the solvent and solids, as already stated in German Offenlegungsschrift No. 2,554,124, so that the filaments and fibres have a minimum water retention capacity of 10%. As is apparent from Table IV, the percentage content of non-solvent in the spinning solution does not influence the profiling action at the nozzle.

However, a minimum viscosity of the spinning solution is crucial. In the case of solids contents of up to 40% by weight, non-solvent portions of from 5 to 10% by weight have proved to be optimum in order to achieve profiled acrylic fibres having a water retention capacity of more than 10%. In addition to a modified cross section which is uniform in shape, the fibres also have a core-sheath structure. The thickness of the fibre sheath may be varied within wide limits by the ratio of polymer solids to non-solvent portion. As is the case when using water as the non-solvent, it is also found when using non-solvents whose boiling points are above that of the spinning solvent, that acrylonitrile copolymers having K values lower than 81 in a higher concentration and acrylonitrile copolymers having K values higher than 81 in a lower concentration produce the required minimum viscosity in the spinning solution. The minimum viscosity may be determined at two different temperatures, i.e. at 80° C. and at 100° C. This measure takes into account the fact thatm on one hand, the determination of the viscosity in spinning solutions which contain water as the non-solvent is difficult because of the evaporation of water at 100° C., whereas on the other hand, the determination of the viscosity in other spinning solutions which, as the nonsolvent, contain a substance whose boiling point is above that of the spinning solvent, may become difficult at 80° C. owing to a tendency to gelatinize. However, the viscosity of aqueous spinning solutions may also be determined at 100° C., when the process is carried out in a closed system.

As long as the spinning solution to be spun produces a finite falling ball second value, it is possible in principle to produce profiled fibres from this spinning solution. However, for economic reasons, spinning solutions having viscosities of more than 300 falling ball seconds, measured at 80° or 100° C., may no longer be processed in a straightforward manner in conventional spinning installations, so that a natural upper limit of the viscosity range results from this.

The water retention capacity (WR) is determined in accordance with the DIN specification No. 53 814 (see Melliant "Textilberichte" 4, 1973, page 350).

The fibre samples are immersed for 2 hours in water which contains 0.1% of a wetting agent. The fibres are then centrifuged for 10 minutes at an acceleration of 10 000 m/sec. and the quantity of water which is retained in and between the fibres is determined gravimetrically. In order to determine the dry weight, the fibres are dried at 105° C. to a constant moisture content. The WR in % by weight is as follows:

$$WR = \frac{m_f - m_{tr}}{m_{tr}} \times 100$$

$m_f$=weight of the most fibre material
$m_{tr}$=weight of the dry fibre material.

In the production of acrylic fibres having modified fibre cross sections, the following are also included as spinning solvents in addition to dimethylformamide: the higher boiling solvents, such as dimethylacetamide, dimethylsulphoxide, ethylene carbonate and N-methylpyrrolidone and the like.

The fibres according to the invention may have individual deniers when stretched of from 1 to 40 dtex, depending on the spinning solution throughput and on the drawing-off conditions.

EXAMPLE 1

59 kg of dimethylformamide (DMF) are mixed with 3 kg of water in a vessel at room temperature with stirring. 38 kg of an acrylonitrile copolymer consisting of 93.6% of acrylonitrile, 5.7% of methyl acrylate and 0.7% of sodium methallylsulphonate and having a K value of 81 are then metered in at room temperature with stirring. The suspension is pumped into a spinning vessel provided with a stirring apparatus via a gear pump. The suspension, which has a solids content of 38% by weight and a water content of 3% by weight, based on the total solution, is then heated with steam at 4.0 bars in a double-walled pipe. The residence time in the pipe is 7 minutes. The temperature of the solution at the pipe outlet is 138° C. Several mixing combs are located in the pipe to homogenise the spinning solution. This solution, which has a viscosity of 176 falling ball seconds at 80° C., is filtered without intermediate cooling after leaving the heating device and is directly conveyed to the spinning duct.

The spinning solution is dry-spun from a 90 hole nozzle having hexalobal nozzle holes (see FIG. 1). The nozzle hole area is 0.0696 $(mm)^2$ and the lateral width is 0.04 mm. The duct temperature is 160° C. and the air temperature is 150° C. The quantity of air which is passed through is 30 $m^3$/hour. The take-off rate is 275 m/min. The spun material with a denier of 750 dtex is collected on bobbins and is doubled into a tow having a total denier of 187,000 dtex. The fibre tow is then stretched in a ratio of 1:4 in boiling water and is after treated in conventional manner to form fibres having an individual final denier of 2.6 dtex. For the microscopic assessment of the cross-sectional geometry, the fibre capillaries are embedded in methyl methacrylate and are cut transversely. The light-microscopic recordings produced in the differential interference contrast process show that the sample cross sections have a completely regular hexalobal structure. The tear strength is 2.9 cN/dtex and the elongation at break is 27%.

The following Table I specifies the production of further modified fibre cross-sectional shapes, as they are obtained in dry spinning from profiled nozzles according to the process of the invention. In all cases, an acrylonitrile copolymer having the chemical composition and concentration of Example 1 is used. The spinning solution is produced as described there, is spun into fibres from the profiled nozzles specified in Table I and is subsequently after treated. The spinning solution was spun in each case from 90-hole nozzles. The filament cross-sectional geometry is determined as specified in Example 1 and is verified with light-microscopic recordings.

TABLE I

| No. | Nozzle hole shape | Nozzle hole area $(mm)^2$ | Lateral width (mm) | FIG. No. | Fibre cross-section structure | Contour precision |
|---|---|---|---|---|---|---|
| 1 | Octalobal | 0.269 | 0.10 | 2 | undefinable bizarre structures | No uniform cross-sectional shape |
| 2 | Octalobal | 0.106 | 0.04 | 3 | octalobal | regular |
| 3 | Pentalobal | 0.090 | 0.08 | 4 | pentalobal | regular |
| 4 | Pentalobal | 0.045 | 0.04 | 5 | pentalobal | regular |
| 5 | Rectangular | 0.105 | 0.14 | 6 | rectangular | regular |
| 6 | Rectangular | 0.204 | 0.17 | 7 | undefined shapes | No uniform cross-sectional shape |
| 7 | Trilobal | 0.030 | 0.04 | 8 | trilobal | regular |
| 8 | Triangular | 0.034 | 0.14 | 9 | triangular | regular |

EXAMPLE 2

Figure 8:
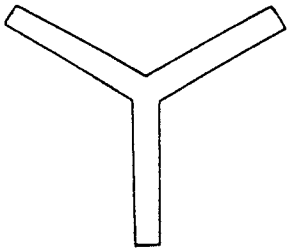
FIG. 8 is a Y-shaped (trilobal) nozzle hole configuration for use in the present invention.
Figure 9:
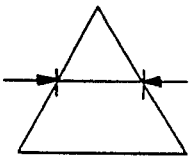
FIG. 9 is a plan view of a triangular shaped nozzle hole configuration for use in the present invention.

An acrylonitrile copolymer having the chemical composition of Example 1 and a K value of 81 is dissolved, filtered and dry-spun from a 90-hole nozzle having trilobal nozzle holes (see FIG. 8) as described in Example 1. The nozzle hole area is 0.03 $(mm)^2$ and the lateral width is 0.04 mm. The duct temperature is 150° C. and the air temperature is 150° C. The quantity of air passed through is 30 $m^3/h$. The take-off rate is 125 m/min. The spun material with a denier of 1500 dtex is collected on bobbins, doubled into a tow having a total denier of 150,000 dtex and is after treated to form fibres having a final denier of 5.0 dtex, as described in Example 1. The sample cross sections of the fibres exhibit a completely regular trilobal cross-sectional profile. The fibre strength is 3.0 cN/dtex. Elongation at break is 24%.

In the following Table II, the limits of the process according to the invention for the production of cross section-modified acrylic fibres by dry-spinning are illustrated using further Examples. In all cases, an acrylonitrile copolymer having the chemical composition of Example 1 is re-used and is converted into a spinning solution, as described in Example 1. The solids concentration and the type and the percentage portion of the non-solvent for PAN are varied. Spinning is carried out from one of the 90 hole nozzles having trilobal nozzle holes described above (see FIG. 8).

The spinning and aftertreatment conditions are as described in Example 2. The viscosities are measured in falling ball seconds at 80° C., as initially described.

TABLE 11

| No. | Viscosity | Non-solvent for PAN | Chem. composition % of spinning solution PAN | non-solvent | DMF | Fibre cross-section | Contour precision |
|---|---|---|---|---|---|---|---|
| 1 | 61 | Water | 34 | 3 | 63 | Dumbbell-shape | No trilobal fibres |
| 2 | 73 | " | 35 | 3 | 63 | Dumbbell + bean | No trilobal fibres |
| 3 | 120 | " | 36 | 3 | 61 | trilobal | regular |
| 4 | 176 | " | 38 | 3 | 59 | " | " |
| 5 | 243 | " | 40 | 3 | 57 | " | " |
| 6 | 75 | " | 35 | 4 | 61 | Dumbbell + bean | No trilobal fibres |
| 7 | 79 | " | 35 | 5 | 60 | Dumbbell + bean | No trilobal fibres |
| 8 | 124 | " | 36 | 4 | 60 | trilobal | regular |
| 9 | 105 | " | 30 | 10 | 60 | Spinning impossible-filaments burst | |
| 10 | 106 | Butanol | 35 | 4 | 61 | Dumbbell + bean | No trilobal fibres |
| 11 | 127 | " | 36 | 4 | 60 | trilobal | regular |
| 12 | 233 | " | 38 | 4 | 58 | " | regular |

EXAMPLE 3

51 kg of DMF are mixed with 4 kg of water in a vessel with stirring. 45 kg of an acrylonitrile copolymer consisting of 92% of acrylonitrile, 6% of methyl acrylate and 2% of sodium methallyl sulphate, having a K value of 60, are then metered in with stirring at room temperature. The suspension, which has a solids concentration of 45%, is dissolved, filtered and dry-spun from a 90 hole nozzle having hexalobal nozzle holes (see FIG. 1) as described in Example 1. The viscosity of the spinning solution is 142 falling ball seconds at 80° C. The nozzle hole area is again 0.0696 $mm^2$ and the lateral width is 0.04 mm. The further spinning and aftertreatment conditions are as described in Example 1. The sample cross sections of the fibres, which have a final denier of 3.1 dtex, exhibit a completely regular hexalobal cross-sectional profile. Fibre strength=2.7 cN/dtex; elongation at break: 31%.

EXAMPLE 4

67 kg of dimethylformamide are mixed with 3 kg of water in a vessel with stirring. 30 kg of an acrylonitrile homopolymer having a K value of 91 according to Fikentscher are then metered in with stirring at room temperature. The suspension, which has a solids concentration of 30%, is again dissolved, filtered and dry-spun from a 90 hole nozzle having trilobal nozzle holes (see FIG. 8), as described in Example 1. The viscosity measured at 80° C. was 138 falling ball seconds. The nozzle hole area is 0.03 $mm^2$ and the lateral width is 0.04 mm. The further spinning and aftertreatment conditions are as described in Example 1. The sample cross sections of the fibres, which have a final denier of 2.0 dtex, exhibit a completely regular trilobal cross-sectional profile. Fibre strength=2.6 cN/dtex; elongation at break=19%.

EXAMPLE 5

57 kg of dimethylformamide (DMF) are mixed with 6 kg of monoethylene glycol in a vessel at room temperature with stirring. 37 kg of an acrylonitrile copolymer consisting of 93.6% of acrylonitrile, 5.7% of methyl acrylate and 0.7% of sodium methallyl sulphonate, having a K value of 81, are then metered in with stirring at room temperature. The suspension is pumped with a gear pump into a spinning vessel provided with a stirrer. The suspension, which has a solids content of 37% by weight and a non-solvent content of 6% by weight, based on the total solution, is then heated with steam at 4.0 bars in a double-walled pipe. The residence time in the pipe is 7 minutes. The temperature of the solution at the pipe outlet is 138° C. Several mixing combs are located in the pipe to homogenize the spinning solution. This solution, which has a viscosity of 186 falling ball seconds at 100° C., is filtered without intermediate cooling after leaving the heating device and is directly conveyed to the spinning duct.

The spinning solution is dry-spun from a 90 hole nozzle having hexalobal nozzle holes (See FIG. 1). The nozzle hole area is 0.0696 $(mm)^2$ and the lateral width is 0.04 mm. The duct temperature is 160° C. and the air temperature is 100° C. The quantity of air passed through is 30 $m^3$/hour. The takeoff rate is 350 m/min. The spun material, having a denier of 475 dtex, is collected on bobbins and is doubled into a tow having a total denier of 142,500 dtex. The fibre tow is then stretched in a ratio of 1:4 in boiling water, is washed, dried at 110° C. and is after treated in conventional manner to form fibres having a final denier of 1.6 dtex. For the microscopic assessment of the cross-sectional geometry, the fibre capillaries are embedded in methyl methacrylate and are cut transversely. The light-microscopic recordings produced in the differential interference contrast process show that the sample cross sections have a completely regular hexalobal shape having a core/sheath structure. The tear strength is 2.6 cN/dtex and the elongation at break is 34%. The portion of the sheath surface is approximately 80%. The water retention capacity is 12.6%.

The following Table III specifies the production of further modified fibre cross sectional shapes, as they are obtained in dry spinning from profiled nozzles according to the process of the invention. In all cases, an acrylonitrile copolymer having the chemical composition and concentration of Example 5 is used. The spinning solution is produced as described in Example 5 and is spun into fibres from the profiled nozzles specififed in Table III, and then after treated. The spinning solution was spun in each case from 90 hole nozzles. The filament cross-sectional geometry was determined, as specified in Example 1, and was confirmed with light-microscopic recordings.

TABLE III

| No. | Nozzle hole shape | Nozzle hole area $(mm)^2$ | Lateral width (mm) | WR | FIG. No. | Fibre cross-section structure | Contour precision |
|---|---|---|---|---|---|---|---|
| 1 | Octalobal | 0.269 | 0.10 | 10.2 | 2 | undefined bizarre structures | No uniform cross-sectional shape |
| 2 | Octalobal | 0.106 | 0.04 | 17.9 | 3 | octalobal | regular |
| 3 | Pentalobal | 0.090 | 0.08 | 14.4 | 4 | pentalobal | regular |
| 4 | Pentalobal | 0.045 | 0.04 | 16.3 | 5 | pentalobal | regular |
| 5 | Rectangle | 0.105 | 0.14 | 13.7 | 6 | rectangular | regular |
| 6 | Rectangle | 0.204 | 0.17 | 11.1 | 7 | undefined shapes | No uniform cross-sectional shape |
| 7 | Trilobal | 0.030 | 0.04 | 15.6 | 8 | trilobal | regular |
| 8 | Triangle | 0.034 | 0.14 | 12.8 | 9 | triangular | regular |

EXAMPLE 6

55 kg of dimethylformamide are mixed with 7 kg of tetraethylene glycol in a vessel with stirring. 38 kg of an acrylonitrile copolymer having the chemical composition of Example 5 and a K value of 81 are then metered in with stirring at room temperature. The suspension, which has a solids concentration of 38%, is again dissolved, filtered and dry-spun from a 90 hole nozzle having trilobal nozzle holes (see FIG. 8), as described in Example 5. The viscosity of the spinning solution, measured at 100° C., is 152 falling ball seconds. The nozzle hole area is 0.03 $mm^2$ and the lateral width is 0.04 mm. The duct temperature is 160° C. and the air temperature is 150° C. The quantity of air passed through is 30 $m^3$/h. The take-off ratio is 250 m/min. The spun material, having a denier of 2100 dtex, is collected on bobbins, doubled into a tow having a total denier of 210,000 dtex and is after treated to form fibres having a final denier of 6.7 dtex, as described in Example 5. The sample cross sections of the fibres which again have a cross/sheath structure exhibit a completely regular trilobal cross-sectional profile. Fibre strength 2.4 cN/dtex; elongation at break: 34%; water retention capacity: 15.2%.

In the following Table IV, the limits of the process according to the invention for the production of cross-section-modified acrylic fibres by dry spinning are illustrated using further Examples. In all cases, an acrylonitrile copolymer having the chemical composition of Example 5 is again used and is converted into a spinning solution, as described in Example 5. The solids concentration and the type and the percentage portion of the non-solvent for PAN are varied. Spinning was carried out from a 90 hole nozzle having trilobal nozzle holes (see FIG. 8). The spinning and aftertreatment conditions are as described in Example 2. The viscosity in falling ball seconds is determined at 100° C.

TABLE IV

| No. | Viscosity | Non-solvent for PAN | Chem. composition % of spinning solution PAN | non-solvent | DMF | Fibre cross-section | Water retention capacity % | Contour precision |
|---|---|---|---|---|---|---|---|---|
| 1 | 58 | tetraethylene glycol | 34 | 7 | 59 | oval to irregular | 20.3 | no trilobal fibres |
| 2 | 72 | tetraethylene glycol | 35 | 7 | 58 | oval to irregular | 18.4 | no trilobal fibres |
| 3 | 100 | tetraethylene glycol | 36 | 7 | 57 | trilobal | 18.1 | regular |
| 4 | 123 | tetraethylene glycol | 37 | 7 | 56 | " | 16.7 | " |
| 5 | 184 | tetraethylene glycol | 36 | 10 | 54 | " | 31.4 | " |
| 6 | 55 | tetraethylene glycol | 35 | 3 | 62 | oval to irregular | 7.4 | no trilobal fibres |
| 7 | 48 | tetraethylene glycol | 34 | 4 | 62 | oval to irregular | 9.7 | no trilobal fibres |
| 8 | 50 | tetraethylene glycol | 34 | 5 | 61 | oval to irregular | 13.2 | no trilobal fibres |
| 9 | 61 | tetraethylene glycol | 34 | 6 | 60 | oval to irregular | 13.3 | no trilobal fibres |
| 10 | 70 | Monoethylene glycol | 34 | 5 | 61 | oval to irregular | 14.1 | no trilobal fibres |
| 11 | 156 | Monoethylene glycol | 36 | 8 | 56 | trilobal | 18.4 | regular |
| 12 | 168 | Glycerine | 36 | 8 | 56 | trilobal | 19.0 | regular |

EXAMPLE 7

50 kg of DMF are mixed with 5 kg of glycerine in a vessel with stirring. 45 kg of an acrylonitrile copolymer consisting of 92% of acrylonitrile, 6% of methyl acrylate and 2% of sodium methallyl sulphonate, having a K value of 60, are then metered in with stirring at room temperature. The suspension, which has a solids concentration of 45%, is dissolved, filtered and dry-spun from a 90 hole nozzle having hexalobal nozzle holes (see FIG. 1), as described in Example 5. The viscosity of the spinning solution is 104 falling ball seconds, measured at 100° C. The nozzle hole area is again 0.0696 $mm^2$ and the lateral width is 0.04 mm. The further spinning and aftertreatment conditions are as described in Example 2. The sample cross sections of the fibres, which have a final denier of 3.1 dtex, exhibit a completely regular hexalobal cross-sectional profile having a core/sheath structure. Fibre strength=2.7 cN/dtex; elongation at break: 31%. Water retention capacity: 10.2%.

EXAMPLE 8

Some of the spinning solution from Example 5 is supplied to another spinning duct after filtration and is dry-spun from a 90 hole nozzle having hexalobal nozzle holes (see FIG. 1). The duct temperature is 220° C. and the air temperature is 360° C. The quantity of air passed through is 40 $m^3$/hour. The take-off rate is 125 m/min. The spun material, having a denier of 1770 dtex, is collected on bobbins, doubled into a tow having a total denier of 177,000 dtex and is then after treated to form fibres having a final denier of 6.7 dtex, as described in Example 5. The same cross sections of the fibres exhibit a completely regular hexalobal cross-sectional profile. However, they no longer have a core/sheath structure, because most of the non-solvent is evaporated in the spinning duct. The water retention capacity is 4.3%.

EXAMPLE 9

Some of the fibre tow from Example 5, having a total denier of 142,500 dtex, was stretched and washed, as described in Example 5, but was then dried at 180° C. in a drum drying machine with an allowance of 20% shrinkage, and was after treated in conventional manner to form fibres having a final denier of 1.6 dtex. The sample cross sections of the fibres exhibit a completely regular hexalobal cross-sectional profile. However, they no longer have a core/sheath structure, because the pore system has been eliminated by the intensified drying conditions. The water retention capacity is 3.9%.

We claim:

1. A process for the production of fibers and filaments of acrylonitrile homopolymers and copolymers, the fibers and filaments having a precise cross-sectional profile, comprising dry-spinning filament-forming synthetic polymers with at least 85% by weight of acrylonitrile units polymerized therein from a solution which has a viscosity of at least 120 falling ball seconds, measured at 80° C., or a viscosity of at least 75 falling ball seconds, measured at 100° C., said solution being formed by preparing a suspension by mixing a spinning solvent with a non-solvent for the polymer to be spun, the non-solvent being 2 to 10% by weight based on the total suspension, the suspension having a solids content of at least 30% for acrylonitrile having a K-value of 91 or higher or having a solids content of at least 32% for an acrylonitrile having a K-value of 81 or lower, adding the polymer with stirring and for a short time heating up to a temperature just below the boiling point of the solvent, through one or more profiled nozzles having a nozzle hole area substantially the same profile as the resulting fiber or filament and being less than 0.2 $mm^2$ and the lateral width being less than 0.17 mm.

2. A process according to claim 1, wherein the synthetic polymer contains at least 92% by weight acrylonitrile units polymerized therein.

3. A process according to claim 1, wherein the nozzle hole area is less than 0.1 $mm^2$ and the lateral width is from 0.02 to 0.06 mm.

4. A process according to claim 1, wherein said non-solvent is miscible in wide limits with the spinning solvent.

5. A process according to claim 4, wherein said non-solvent is selected from the group consisting of water, glycerin, monoethylene glycol, tetraethylene glycol and sugar.

6. A process according to claim 5, wherein water is the non-solvent.

7. A process according to claim 1, wherein the spinning solvent is dimethylformamide.

8. A process according to claim 7, wherein said polymer is a copolymer comprising acrylonitrile, methyl acrylate and sodium methylsulfonate.

9. A process according to claim 4, wherein said non-solvent has a boiling point below that of the spinning solution and wherein fibers having a water retention capacity of less than 10% are obtained.

10. A process according to claim 4, wherein said non-solvent has a boiling point above that of the spinning solution and wherein fibers having a water retention capacity of more than 10% are obtained.

11. A process according to claim 10, wherein for solid contents of up to 40% by weight in the solution, non-solvent portions of from 5 to 10% weight are utilized.

* * * * *

UNITED STATES PATENT AND TRADEMARK OFFICE

CERTIFICATE OF CORRECTION

PATENT NO. : 4,810,448

DATED : March 7, 1989

INVENTOR(S) : Reinehr, et al.

It is certified that error appears in the above-identified patent and that said Letters Patent is hereby corrected as shown below:

| | |
|---|---|
| Title Page, under "Foreign Patent Documents, line 3 | Correct date to --8/1979-- |
| Col. 5, line 67 | Delete "most" and substitute --moist-- |
| Col. 14, line 11 | Add the following claim:<br>--12. A process according to claim 1, wherein the viscosity of the solution, measured at 80°C, is from 120 to 300 falling ball seconds and, measured at 100°C, is from 75 to 100 falling ball seconds.-- |

Signed and Sealed this

Tenth Day of July, 1990

*Attest:*

HARRY F. MANBECK, JR.

*Attesting Officer*

*Commissioner of Patents and Trademarks*